US006062344A

United States Patent [19]

Okabe et al.

[11] Patent Number: 6,062,344

[45] Date of Patent: May 16, 2000

[54] ELEVATOR SYSTEM

[75] Inventors: Sueo Okabe; Toshiaki Ishii, both of Tokyo, Japan

[73] Assignee: Mitsubishi Denki Kabushiki Kaisha, Tokyo, Japan

[21] Appl. No.: 09/255,851

[22] Filed: Feb. 23, 1999

[30] Foreign Application Priority Data

Sep. 3, 1998 [JP] Japan ..... 10-249785

[51] Int. Cl.[7] ..... B66B 9/00

[52] U.S. Cl. ..... 187/249; 187/256; 187/257; 187/349; 187/411

[58] Field of Search ..... 187/249, 256, 187/257, 349, 411, 902

[56] References Cited

U.S. PATENT DOCUMENTS 1,837,643 12/1931 Anderson ..... 187/249
5,758,748 6/1998 Barker et al. ..... 187/249
5,829,553 11/1998 Wan et al. ..... 187/249 X
5,857,545 1/1999 Barrett et al. ..... 187/249

*Primary Examiner*—James W. Keenan
*Assistant Examiner*—Steven B. McAllister
*Attorney, Agent, or Firm*—Leydig, Voit & Mayer, Ltd.

[57] ABSTRACT

In an elevator system, first and second car carrying bases move up and down along first and second segments of a hoistway, respectively. First and second support members are located on the first and second car carrying bases, respectively. A car is moved up and down within the hoistway while being selectively supported by the first or second car carrying base. The first and second car carrying bases are arranged so as not to overlap each other when projected on a horizontal plane. Each car support member can shuttle between a support position and a nonsupport position, the support position being a position at which the car support member supports the car by projecting into a moving path of the car and the nonsupport position being a position at which the car support member is retracted from and is outside of the moving path of the car.

5 Claims, 11 Drawing Sheets

ELEVATOR SYSTEM

BACKGROUND OF THE INVENTION

1. Field of the Invention

The present invention relates to high-travel elevator systems that are installed in, e.g., high-rise buildings.

2. Description of the Related Art

The travel of an elevator system is generally not more than 700 to 800 meters as restricted by the weight of the ropes for suspending a car. Thus, passengers must utilize a plurality of vertically arranged elevator systems to climb higher than the aforementioned travel by making connections from one elevator system to another.

FIG. 14 is a diagram showing the construction of a conventional double-deck elevator system disclosed in, e.g., Japanese Patent Application Laid-open No. 9-165149. A first hoisting machine 12 moves a first double-deck frame 11 up and down along a lower hoistway 13. A second hoisting machine 15 moves a second double-deck frame 14 up and down along an intermediate hoistway 16. Finally, a third hoisting machine 18 moves a third double-deck frame 17 up and down along an upper hoistway 19.

The lower end of the intermediate hoistway 16 neighbors the upper end of the lower hoistway 13. The lower end of the upper hoistway 19 neighbors the upper end of the intermediate hoistway 16. A first car 21 is mounted on upper portions of the double-deck frames 11, 14 and 17, and moves up and down within the hoistways 13, 16 and 19. Further, a second car 22 is mounted on lower portions of the double-deck frames 11, 14 and 17, and moves up and down within the hoistways 13, 16 and 19.

Further, the first and second cars 21 and 22 are pushed by pushing devices 23*a* to 23*h* at a communicating space between the lower hoistway 13 and the intermediate hoistway 16 and a communicating space between the intermediate hoistway 16 and the upper hoistway 19, so that the cars 21 and 22 move between the first and second double-deck frames 11 and 14 and between the second and third double-deck frames 14 and 17. That is, the first and second cars 21 and 22 move up and down along the three hoistways 13, 16 and 19 by transferring from the double-deck frame 11 to the frame 14, and then to the frame 17, and by transferring in the reverse thereof.

In the conventional elevator system constructed as described above, space to accommodate two neighboring hoistways must be ensured at each relay floor, decreasing building utilization efficiency. Further, the three hoistways 13, 16 and 19 are not arranged linearly, and this complicates the architectural design of the building. Still further, in order to move the cars 21 and 22 between the double-deck frames 11 and 14, and 14 and 17, the double-deck frames 11 and 14 or the double-deck frames 14 and 17 must be stopped side by side at the relay floor and then the cars 21 and 22 must be pushed. This slows the movement of the cars 21 and 22 between the double-deck frames 11 and 14, and 14 and 17, thus impairing passenger handling efficiency.

SUMMARY OF THE INVENTION

The present invention has been made to overcome the aforementioned problems. An object of the present invention is, therefore, to provide an elevator system that can reduce the space for installing hoistways, simplify the architectural design of a building, and improve the handling efficiency.

To this end, according to one aspect of the present invention, there is provided an elevator system comprising:

a hoistway having a first segment and a second segment neighboring an upper portion of the first segment; a first car carrying base being provided within the hoistway, having a first car support member and moving up and down along the first segment; a second car carrying base being provided within the hoistway, having a second car support member and moving up and down along the second segment; and a car moving up and down along the hoistway while being selectively supported by the first or second car carrying base; wherein the first and second car carrying bases are arranged so as not to overlap each other when vertically projected on a plane, and each of the car support members can shuttle between a support position and a nonsupport position, the support position being a position at which the car support member supports the car by projecting into a moving path of the car, the nonsupport position being a position at which the car support member is retracted outside the moving path of the car.

DETAILED DESCRIPTION OF THE PREFERRED EMBODIMENTS

Embodiments of the present invention will now be described with reference to the drawings.

First Embodiment

Figure 1:
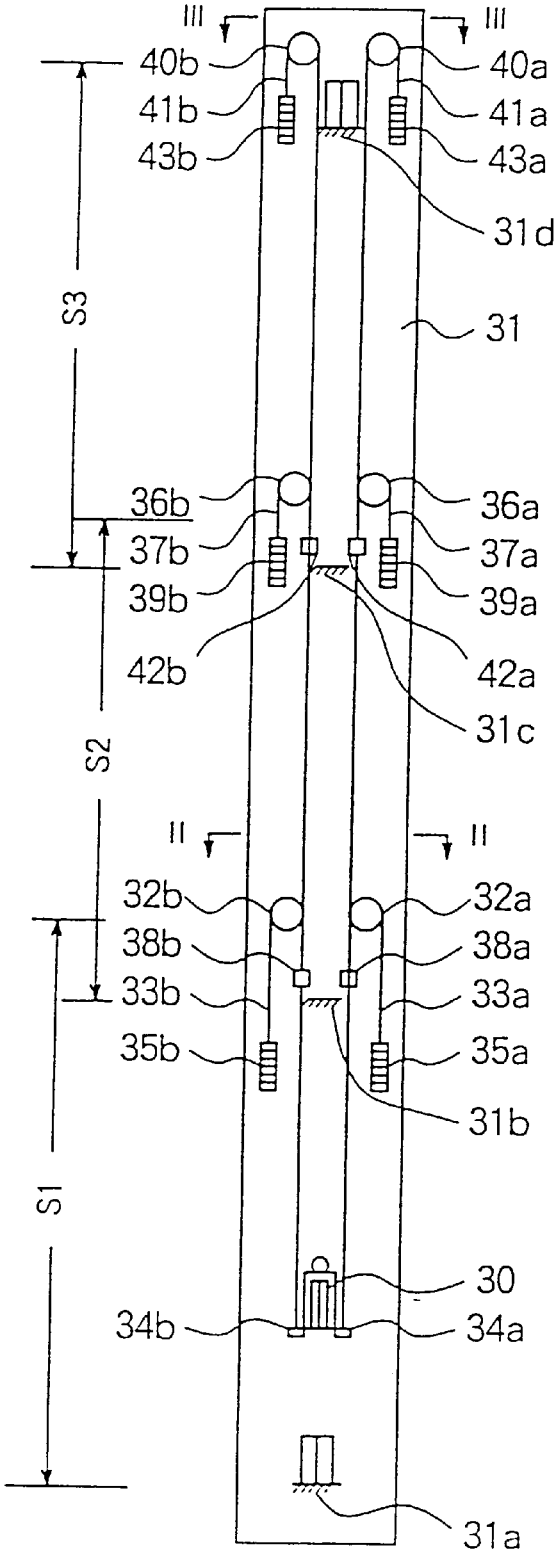
FIG. 1 is a block diagram showing an elevator system in accordance with a first embodiment of the present invention.

FIG. 1 is a block diagram of an elevator system in accordance with a first embodiment of the present invention.

Figure 2:
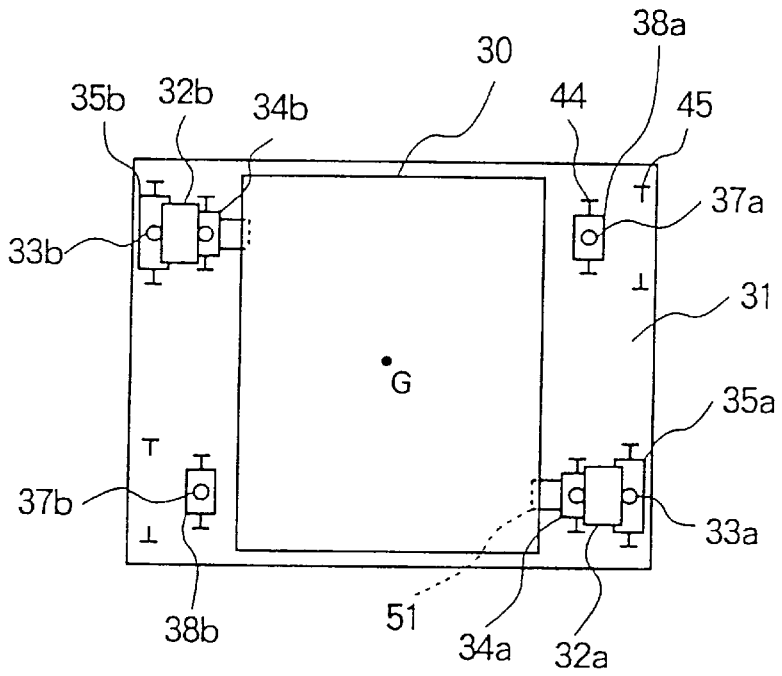
FIG. 2 is a sectional view taken along the line II—II of FIG. 1.
Figure 3:
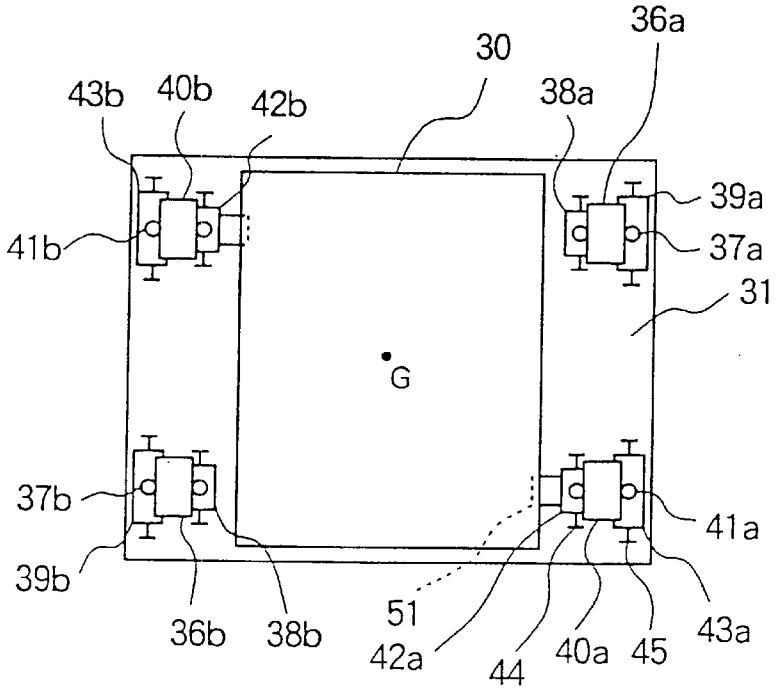
FIG. 3 is a sectional view taken along the line III—III of FIG. 1.

FIG. 2 is a sectional view taken along the line II—II of FIG. 1. FIG. 3 is a sectional view taken along the line III—III of FIG. 1.

In FIGS. 1 to 3, a hoistway 31 extending linearly in a vertical direction has a first segment S1, a second segment S2 neighboring the upper portion of the first segment S1, and a third segment S3 neighboring the upper portion of the second segment S2. Further, the lowermost floor hall 31*a*, a plurality of intermediate floor halls 31*b* and 31*c*, and the uppermost floor hall 31*d* are provided in the hoistway 31. A car 30 moves up and down along the hoistway 31.

A pair of first hoisting machines 32*a* and 32*b* for moving the car 30 up and down are provided at the top of the first segment S1 of the hoistway 31. Ropes 33*a* and 33*b* are passed round the sheaves of the first hoisting machines 32*a* and 32*b*, respectively. A pair of first car carrying bases 34*a* and 34*b* for supporting the car 30 are suspended from one end of each of the ropes 33*a* and 33*b*, and counterweights 35*a* and 35*b* are suspended from the other ends of the ropes 33*a* and 33*b*.

A pair of second hoisting machines 36*a* and 36*b* for moving the car 30 up and down are provided at the top of the second segment S2 of the hoistway 31. Ropes 37*a* and 37*b* are passed round the sheaves of the second hoisting machines 36*a* and 36*b*, respectively. A pair of second car carrying bases 38*a* and 38*b* for supporting the car 30 are suspended from one end of each of the ropes 37*a* and 37*b*, and counterweights 39*a* and 39*b* are suspended from the other ends of the ropes 37*a* and 37*b*.

A pair of third hoisting machines 40a and 40b for moving the car 30 up and down are provided at the top of the third segment S3 of the hoistway 31. Ropes 41*a* and 41*b* are passed round the sheaves of the third hoisting machines 40*a* and 40*b*, respectively. A pair of third car carrying bases 42*a* and 42*b* for supporting the car 30 are suspended from one end of each of the ropes 41*a* and 41*b*, and counterweights 43*a* and 43*b* are suspended from the other ends of the ropes 41*a* and 41*b*.

The first and second car carrying bases 34*a*, 34*b*, 38*a* and 38*b* are arranged so as not to overlap each other when projected on a horizontal plane. Further, the second and third car carrying bases 38*a*, 38*b*, 42*a* and 42*b* are also arranged so as not to overlap each other when vertically projected on the horizontal plane.

Four pairs of car carrying base guide rails 44 for guiding the vertical movement of the car carrying bases 34*a*, 34*b*, 38*a*, 38*b*, 42*a* and 42*b* and four pairs of counterweight guide rails 45 for guiding the vertical movement of the counterweights 35*a*, 35*b*, 39*a*, 39*b*, 43*a* and 43*b* are provided within the hoistway 31.

As shown in FIGS. 2 and 3, the car carrying bases 34*a*, 34*b*, 38*a*, 38*b*, 42*a* and 42*b* are arranged so as to support the car 30 at symmetrical positions with respect to the center of gravity G of the car 30. Therefore, the car 30 is supported stably by the car carrying bases 34*a*, 34*b*, 38*a*, 38*b*, 42*a* and 42*b*.

Figure 4:
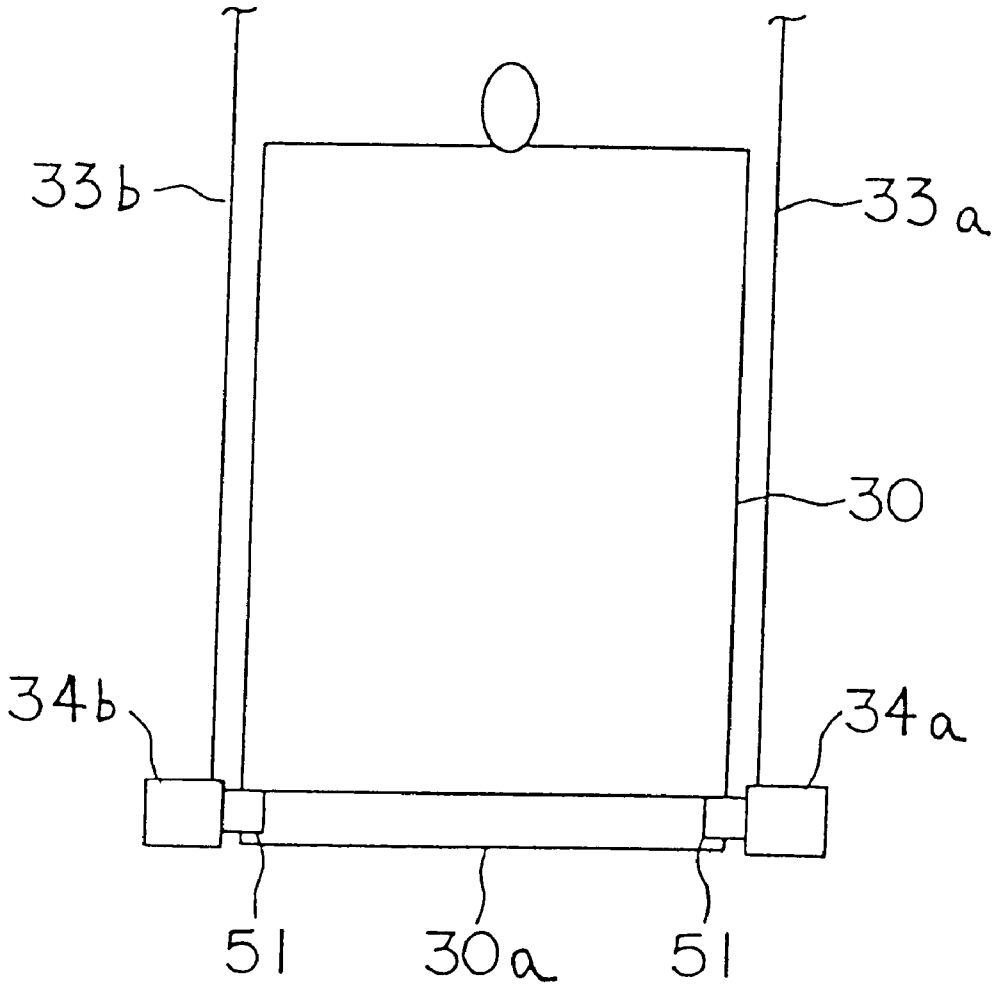
FIG. 4 is a front view showing a car of FIG. 1.

FIG. 4 is a front view showing the car 30 of FIG. 1. A car support member 51 for supporting the car 30 is provided on each of the car carrying bases 34*a*, 34*b*, 38*a*, 38*b*, 42*a* and 42*b*. Each car support member 51 can shuttle between a support position and a nonsupport position. The support position is a position at which the member 51 engages a frame 30*a* of the car 30 by projecting into a moving path (moving region) of the car 30. The nonsupport position is a position at which the member 51 is retracted from and outside of the moving path of the car 30. When the car support members 51 are in the nonsupport position, the car 30 can move past the car carrying bases 34*a*, 34*b*, 38*a*, 38*b*, 42*a* and 42*b* within the hoistway 31.

Figure 5:
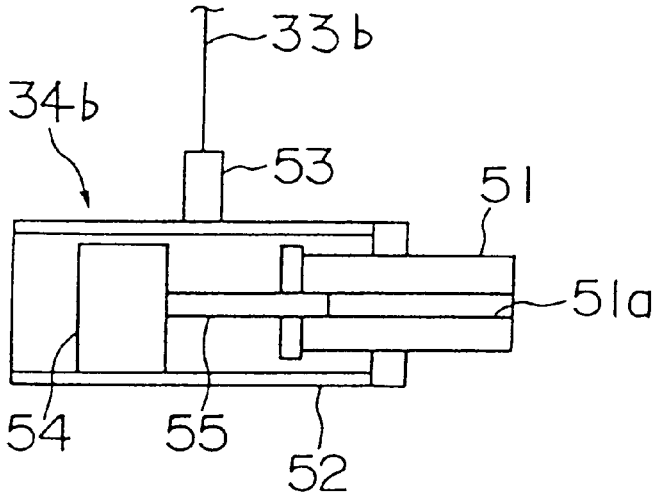
FIG. 5 is a block diagram showing a car carrying base of FIG. 4.
Figure 6:
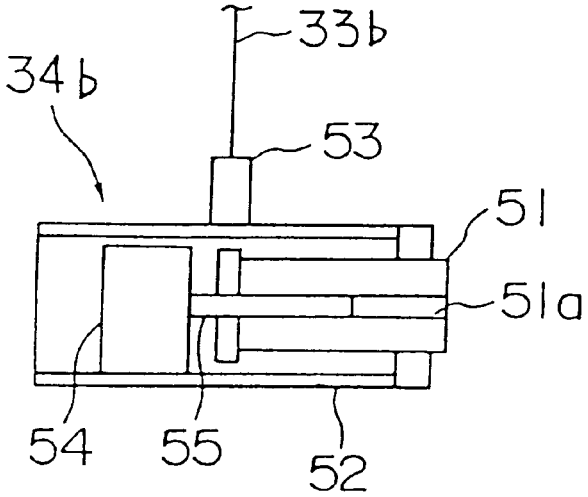
FIG. 6 is a block diagram showing a condition in which a car support section of FIG. 5 is set in a nonsupport position.

FIG. 5 is a block diagram of the car carrying base 34*b* of FIG. 4; and FIG. 6 is a block diagram showing a condition in which the car support member 51 of FIG. 5 is in the nonsupport position. The other car carrying bases 34*a*, 38*a*, 38*b*, 42*a* and 42*b* have a construction similar to that shown in FIGS. 5 and 6. The car carrying base 34*b* has a carrying base frame 52, a rope connecting member 53 that connects the rope 33*b* to the frame 52, a motor 54 that is provided within the frame 52, a screw rod 55 that is rotated by the motor 54, and the car support member 51 that is provided in the frame 52 so as to be projectable from and retractable into the frame 52.

The car support member 51 has a threaded hole 51*a* into which the screw rod 55 is threadedly inserted. Upon rotation of the screw rod 55 by the motor 54, the car support member 51 moves forward and backward, shuttling between the support position shown in FIG. 5 and the nonsupport position shown in FIG. 6.

Figure 7:
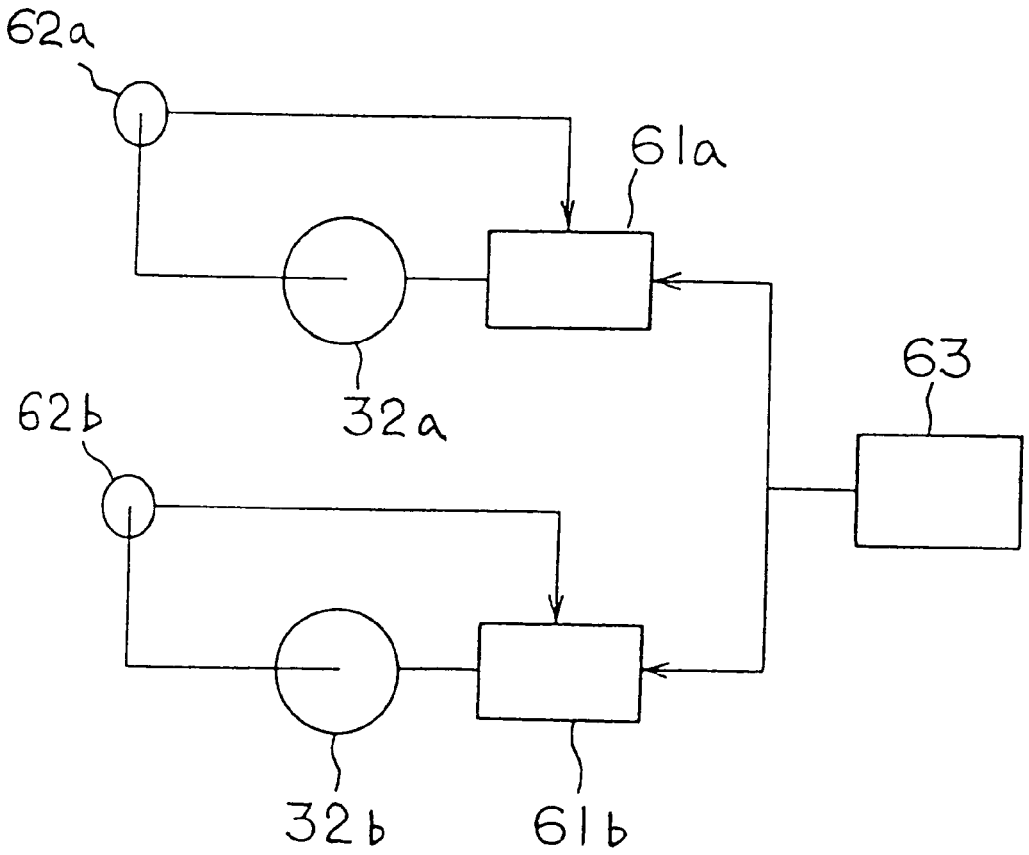
FIG. 7 is an explanatory drawing of a method of controlling the ascent/descent speed of the car carrying bases of FIG. 4.

FIG. 7 is an explanatory drawing of a method of controlling the ascent/descent speed of the car carrying bases 34*a* and 34*b* of FIG. 4. The hoisting machines 32*a* and 32*b* that move the car carrying bases 34*a* and 34*b* up and down are controlled by controllers 61*a* and 61*b*. The hoisting machines 32*a* and 32*b* have speed detectors 62*a* and 62*b*, such as encoders, for detecting the rotational speeds of their sheaves. Detected signals from these speed detectors 62*a* and 62*b* are fed back to the controllers 61*a* and 61*b*.

A controller 63 sends the same speed signal to the controllers 61*a* and 61*b*, so that the hoisting machines 32*a* and 32*b* are controlled to rotate their sheaves at the same speed. Similar ascent/descent speed control is performed for the second car carrying bases 38*a* and 38*b* and the third car carrying bases 42*a* and 42*b*.

Figure 8:
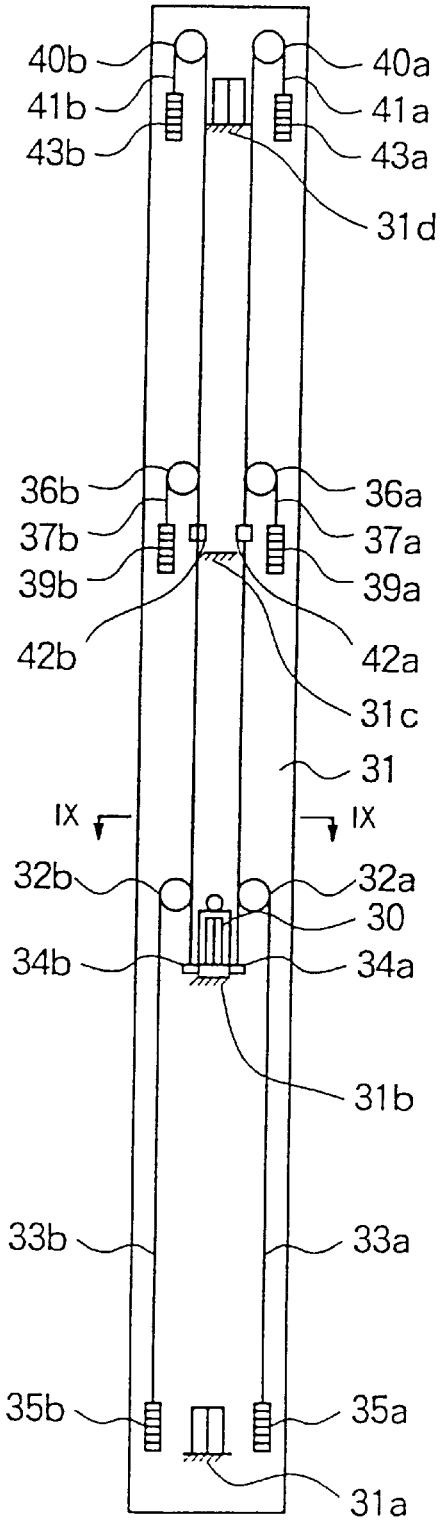
FIG. 8 is a block diagram showing a condition in which the car of FIG. 1 is moved to an intermediate floor hall.

Next, operation of the elevator system will be described. The car 30 is moved up along the first segment S1 of the hoistway 31 by the hoisting machines 32*a* and 32*b* while being supported by the first car carrying bases 34*a* and 34*b*. Then, as shown in FIG. 8, the car 30 stops at the intermediate floor hall 31*b*. The second car carrying bases 38*a* and 38*b* stand by at the intermediate floor hall 31*b*, and the car 30 stops at a position at which the first car carrying bases 34*a* and 34*b* are level with the second car carrying bases 38*a* and 38*b*. At this point in time, the car support members 51 of the second car carrying bases 38*a* and 38*b* are set in the nonsupport position.

Figure 9:
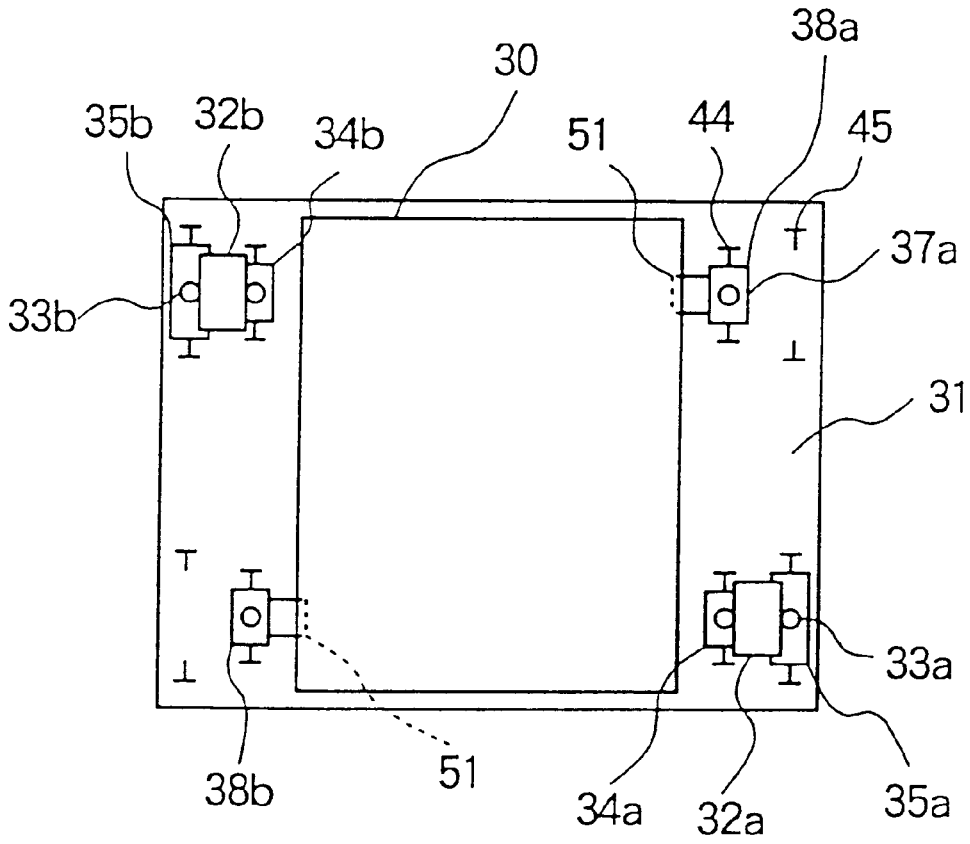
FIG. 9 is a sectional view taken along the line IX—IX of FIG. 8 showing the condition in which the car is delivered from first car carrying bases to second car carrying bases.

Then, as shown in FIG. 9, the car support members 51 of the second car carrying bases 38*a* and 38*b* are moved forward to the support position, whereas the car support members 51 of the first car carrying bases 34*a* and 34*b* are moved backward to the nonsupport position. As a result, the car 30 is delivered to the second car carrying bases 38*a* and 38*b* from the first car carrying bases 34*a* and 34*b*, and is moved up along the second segment S2 of the hoistway 31 by the hoisting machines 36*a* and 36*b* while being supported by the second car carrying bases 38*a* and 38*b*.

Further, the car 30 is delivered to the third car carrying bases 42*a* and 42*b* from the second car carrying bases 38*a* and 38*b* at the intermediate floor hall 31*c*, and is moved up along the third segment S3 of the hoistway 31 by the hoisting machines 40*a* and 40*b*. When moving down, the car 30 is delivered in the reverse order of the above, from the third car carrying bases 42*a* and 42*b* to the second car carrying bases 38*a* and 38*b*, and from the second car carrying bases 38*a* and 38*b* to the first car carrying bases 34*a* and 34*b*.

In such an elevator system, each car support member 51 can shuttle between the support position and the nonsupport position, and thus the car 30 can be delivered between the car carrying bases 34*a*, 34*b* and 38*a*, 38*b*, and between 38*a*, 38*b* and 42*a*, 42*b* midway in the linearly extending hoistway 31. Therefore, such an elevator system contributes not only to reducing the space for installing hoistways so as to improve the utilization efficiency of a building, but also to simplifying the architectural design thereof.

Further, when the car 30 is delivered between the car carrying bases 34*a*, 34*b* and 38*a*, 38*b*, and between bases 38*a*, 38*b* and 42*a*, 42*b*, only the car support members 51 are moved forward and backward while the car 30 is stopped. Therefore, the delivery operation is simplified, which in turn contributes to improving passenger handling efficiency.

Second Embodiment

Next, a second embodiment of the present invention will be described. The general construction of an elevator system according to the second embodiment is similar to that according to the first embodiment. Unlike the first embodiment in which the car 30 is delivered between the car carrying bases 34*a*, 34*b* and 38*a*, 38*b*, and between bases 38*a*, 38*b* and 42*a*, 42*b* while being temporarily stopped, in the second embodiment the car 30 is delivered without being stopped.

Figure 10:
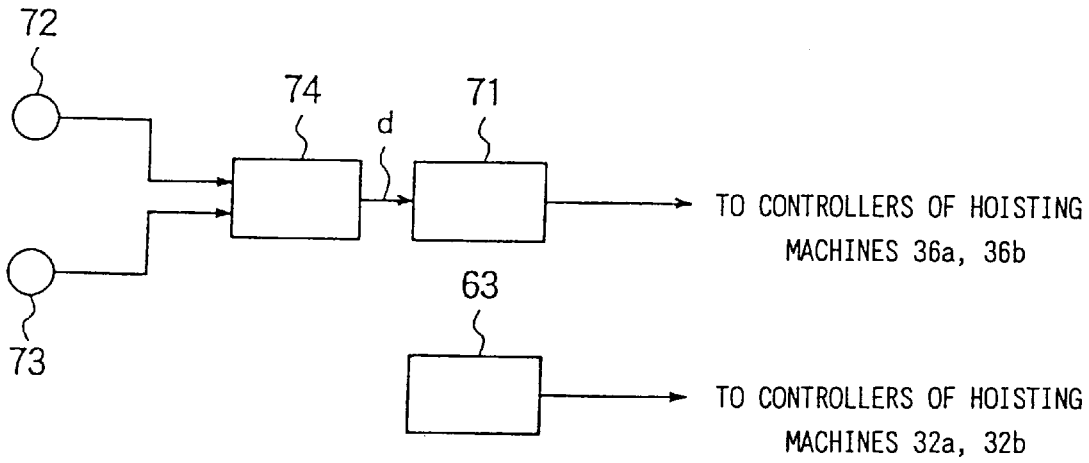
FIG. 10 is an explanatory drawing of a method of controlling the ascent/descent speeds of car carrying bases of an elevator system in accordance with a second embodiment of the present invention.

FIG. 10 is an explanatory diagram of a method of controlling the moving speeds of car carrying bases of the elevator system according to the second embodiment of the present invention. The moving speed of the first car carrying bases 34*a* and 34*b* is controlled by the controller 63 as in FIG. 7. The ascent/descent speed of the second car carrying bases 38*a* and 38*b* is controlled by a controller 71.

Position sensors 72 and 73 detect the absolute positions of the first and second car carrying bases 34*a*, 34*b*, 38*a* and 38*b* within the hoistway 31. A distance detector 74 calculates a relative distance d between the first car carrying bases 34*a* and 34*b* and the second car carrying bases 38*a* and 38*b* based on signals from the position sensors 72 and 73. The controller 63 controls the ascent/descent speed of the second car carrying bases 38*a* and 38*b* based on a signal relating to the distance d sent from the distance detector 74.

Figure 11:
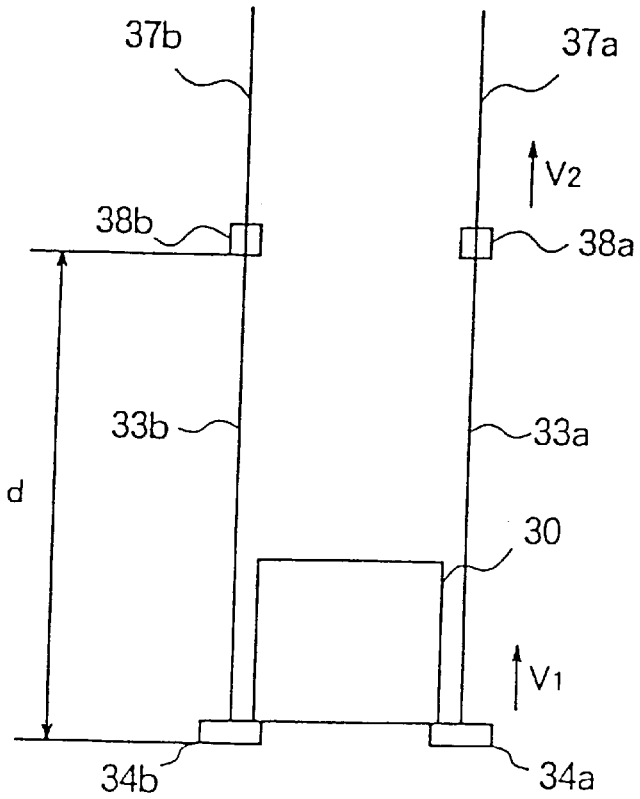
FIG. 11 is an explanatory drawing of a relationship between first and second car carrying bases according to the second embodiment.
Figure 12:
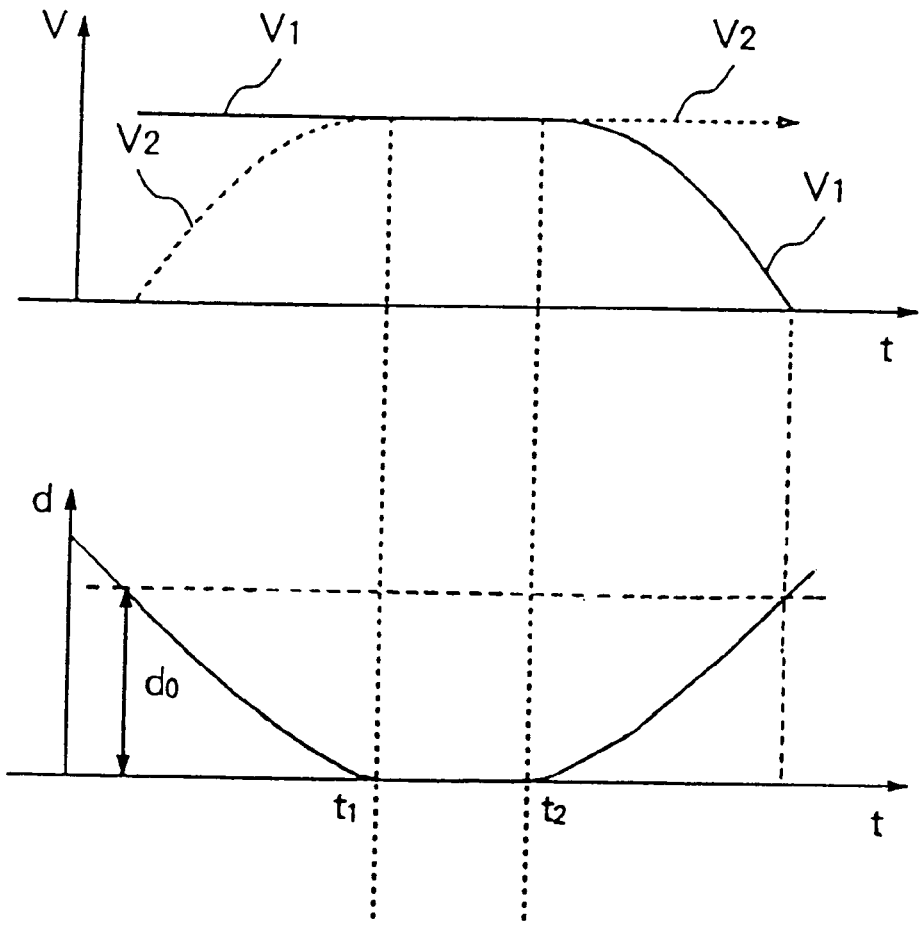
FIG. 12 is a graph for relating changes in the ascent/descent speed and changes in the relative distance of the first and second car carrying bases of FIG. 11.

FIG. 11 is an explanatory drawing of a relationship between the first and second car carrying bases according to the second embodiment; and FIG. 12 is a graph relating changes in the moving speed and changes in the relative distance of the first and second car carrying bases of FIG. 11. As in the first embodiment, when the first car carrying bases 34*a* and 34*b* supporting the car 30 move up, and the relative distance d with respect to the second car carrying bases 38*a* and 38*b* becomes equal to a predetermined distance $d_0$, the controller 71 causes the second car carrying bases 38*a* and 38*b* to move up at a speed $v_2$ as shown in FIG. 12.

The ascending speed $v_2$ of the second car carrying bases 38*a* and 38*b* is controlled by the controller 71 so that the relative distance d with respect to the first car carrying bases 34*a* and 34*b* exhibits the change shown in FIG. 12. Then, while the first and second car carrying bases 34*a*, 34*b*, 38*a* and 38*b* have the same speed and their relative distance is zero during a time period between t1 and t2, the car 30 is delivered from the first car carrying bases 34*a* and 34*b* to the second car carrying bases 38*a* and 38*b* as in the first embodiment.

Thereafter, the first car carrying bases 34*a* and 34*b* are decelerated and stopped as shown by $v_1$ of FIG. 12. Further, the second car carrying bases 38*a* and 38*b* move up while supporting the car 30. The car 30 is similarly delivered from the second car carrying bases 38*a* and 38*b* to the third car carrying bases 42*a* and 42*b*. Still further, similar control is performed for the delivery of the car 30 at the time of its downward movement from the third car carrying bases 42*a* and 42*b* to the second car carrying bases 38*a* and 38*b*, and from the second car carrying bases 38*a* and 38*b* to the first car carrying bases 34*a* and 34*b*.

As described above, the delivery of the car 30 between the car carrying bases 34*a*, 34*b* and 38*a*, 38*b*, and between bases 38*a*, 38*b* and 42*a*, 42*b* is effected at places where the hoistway segments of the bases 34*a*, 34*b*, 38*a*, 38*b*, 42*a* and 42*b* overlap each other, without stopping the car 30. Hence, the passenger handling efficiency can be further improved.

Third Embodiment

Figure 13:
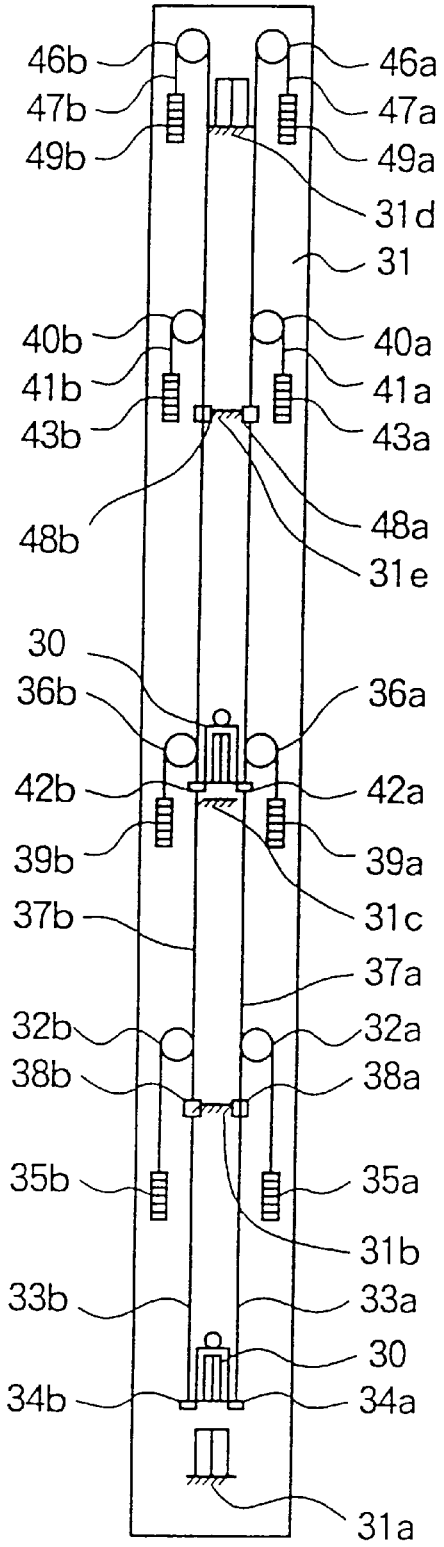
FIG. 13 is a block diagram of an elevator system in accordance with a third embodiment of the present invention.
Figure 14:
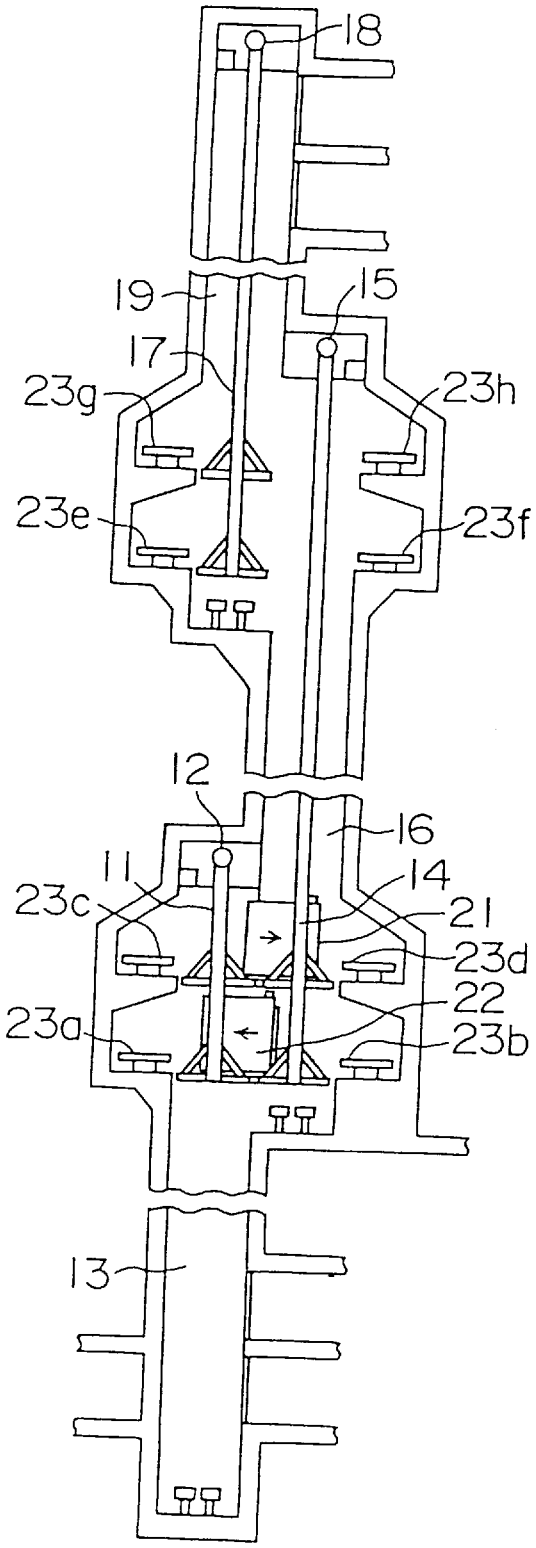
FIG.14 PRIOR ART
FIG. 14 is a block diagram of a conventional double-deck elevator system.

While the first to third car carrying bases 34*a*, 34*b*, 38*a*, 38*b*, 42*a*, and 42*b* are used in the first and second embodiments, the number of car carrying bases is not limited to that in these examples. As shown in FIG. 13 as another example, hoisting machines 46*a* and 46*b*, ropes 47*a* and 47*b*, fourth car carrying bases 48*a* and 48*b* and counterweights 49*a* and 49*b* may be additionally provided.

Further, while a single car 30 is employed in the first and second embodiments, a plurality of cars 30 may be arranged within a single hoistway 31 as shown in FIG. 13.

What is claimed is:

1. An elevator system comprising:

a hoistway having a first segment and a second segment neighboring an upper portion of the first segment;

a plurality of first car carrying bases located within the hoistway, each first car carrying base having a first car support member and moving up and down the first segment;

a plurality of second car carrying bases located within the hoistway, each second car carrying base having a second car support member and moving up and down the second segment; and a car moving up and down the hoistway while being selectively supported by said plurality of first or second car carrying bases, wherein said plurality of first and second car carrying bases do not overlap each other when projected onto a horizontal plane, said plurality of first or second car support members support said car at positions symmetrical with respect to a center of gravity of said car, and each of said car support members shuttles between a support position and a nonsupport position, the support position of said each of said car support members being a position at which said each of said car support members supports said car by projecting into a moving path of said car, the nonsupport position being a position at which said each of said car support members is retracted from and is outside the moving path of said car.

2. The elevator system according to claim 1, further comprising:

a plurality of hoisting machines for moving up and down said plurality first and second car carrying bases, respectively;

a plurality of ropes passing around said hoisting machines, from first ends of which said plurality of first and second car carrying bases are suspended; and a plurality of counterweights suspended from second ends of said plurality of ropes.

3. The elevator system according to claim 1, wherein the first and second segments partially overlap each other, and said car is delivered between said plurality of first and second car carrying bases at portions where the first and second segments overlap each other while said car is moving up and down.

4. An elevator system according to claim 1, including plurality of cars within the hoistway.

5. An elevator system comprising:

a hoistway having a first segment and a second segment neighboring an upper portion of the first segment;

a pair of first car carrying bases located within the hoistway, each first car carrying base having a first car support member and moving up and down the first segment;

a pair of second car carrying bases located within the hoistway, each second car carrying base having a second car support member and moving up and down the second segment; and a car moving up and down the hoistway while being selectively supported by said pair of first or second car carrying bases, wherein said pair of first and second car carrying bases do not overlap each other when projected onto a horizontal plane, said pair of first or second car support members support said car at positions symmetrical with respect to a center of gravity of said car, and each of said car support members shuttles between a support position and a nonsupport position, the support position of said each of said car support members being a position at which said each of said car support members supports said car by projecting into a moving path of said car, the nonsupport position being a position at which said each of said car support members is retracted from and is outside the moving path of said car.

* * * * *